United States Patent [19]

Honger

[11] Patent Number: 4,674,934

[45] Date of Patent: Jun. 23, 1987

[54] APPARATUS FOR STACKING PAPER SHEETS AND THE LIKE

[75] Inventor: Hanspeter Honger, Zofingen, Switzerland

[73] Assignee: Grapha-Holding AG, Hergiswil, Switzerland

[21] Appl. No.: 719,920

[22] Filed: Apr. 4, 1985

[30] Foreign Application Priority Data

May 11, 1984 [CH] Switzerland ..... 2329/84-2

[51] Int. Cl.[4] ..... B65H 33/16

[52] U.S. Cl. ..... 414/103; 198/431; 198/470.1; 271/177; 271/181; 414/43

[58] Field of Search ..... 198/431, 469.1, 470.1, 198/484.1, 855; 271/177, 181, 180, 190, 213; 414/43, 47, 103

[56] References Cited

U.S. PATENT DOCUMENTS 1,481,431 1/1924 Plumb ..... 414/103 X
4,172,531 10/1979 Müller ..... 271/181 X
4,180,154 12/1979 Andersson ..... 198/431 X

FOREIGN PATENT DOCUMENTS 423797 2/1935 United Kingdom ..... 198/431

*Primary Examiner*—Frank E. Werner
*Assistant Examiner*—Janice Krizek
*Attorney, Agent, or Firm*—Peter K. Kontler

[57] ABSTRACT

Apparatus for accumulating rows of paper sheets which are disposed in vertical planes has two pairs of endless chain conveyors whose upper reaches advance at a relatively low speed below two sheet feeding conveyors which deposit successive sheets between the front and rear sheet confining plates of one pair of chain conveyors while the chain conveyors of the other pair advance a fully grown row at a relatively high speed below a pair of claws which lift the fully grown row and transfer it sidewise to the next processing station. The chain conveyors of the other pair then advance their sheet confining plates at the high speed to a waiting position in which their leading confining plate is located immediately behind the trailing confining plate of the chain conveyors of the one pair. The cycle is thereupon repeated except that the growing row of sheets is being accumulated between the plates of the chain conveyors of the other pair.

15 Claims, 3 Drawing Figures

APPARATUS FOR STACKING PAPER SHEETS AND THE LIKE

BACKGROUND OF THE INVENTION

The present invention relates to apparatus for manipulating sheets of paper or the like, and more particularly to improvements in apparatus for converting a series of successive sheets into successive rows wherein the sheets at least substantially fully overlap each other.

It is already known to employ in such apparatus a first transporting unit including an endless belt or chain conveyor which carries one or more pairs of sheet confining members and advances such confining members along an endless path past a sheet feeding station where a second transporting unit delivers successive sheets of the series into the space between a pair of neighboring confining members. The confining members which flank the growing row of sheets advance along their path and the fully grown row is removed from such path downstream of the second transporting unit. It is also known to design the second transporting unit in such a way that it delivers sheets along a vertical or nearly vertical path from above and into the space between those confining members which advance along the sheet feeding station. Reference may be had to commonly owned U.S. Pat. No. 4,172,531 to Hans Müller, to Swiss Pat. No. 574,861 and to British Pat. No. 1,527,515. A drawback of heretofore known apparatus of the above outlined character is that the frequency at which they accumulate rows of at least substantially fully overlapping sheets is too low. Furthermore, the presently known apparatus are rather complex, bulky and prone to malfunction.

OBJECTS AND SUMMARY OF THE INVENTION

An object of the invention is to provide a novel and improved apparatus which can convert a series of successive sheets (such as a stream of partially overlapping folded sheets which are provided with printed matter and are to be gathered into books, pamphlets, newspapers and other publications) into a succession of fully grown rows of fully or nearly fully overlapping sheets at a high frequency, in a small area and with assistance from relatively simple, compact and reliable instrumentalities.

Another object of the invention is to provide an apparatus which, if designed to accumulate fully grown rows at the heretofore customary frequency, affords more time for manual or semiautomatic removal of the rows.

A further object of the invention is to provide the apparatus with novel and improved sheet confining members and with novel and improved conveyor means for such sheet confining members.

An additional object of the invention is to provide novel and improved means for moving the sheet confining members in an apparatus of the above outlined character.

Still another object of the invention is to provide a novel and improved method of converting a succession of sheets, especially a scalloped stream of partially overlapping paper sheets, into a series of fully grown rows of sheets wherein the neighboring sheets are disposed in vertical or nearly vertical planes.

Another object of the invention is to provide an apparatus of the above outlined character which can be installed in existing production lines as a superior substitute for heretofore known row forming apparatus.

An additional object of the invention is to provide an apparatus which can be rapidly converted for the accumulation of shorter or longer rows and whose operation can be automated to any desired extent.

The invention is embodied in an apparatus for converting a series of sheets, particularly a stream of partially overlapping folded sheets which carry printed matter, into successive rows of at least substantially fully overlapping sheets. The apparatus comprises a first transporting unit which defines an endless path and includes discrete first and second conveyor means, means for moving the first and second conveyor means along the endless path independently of each other in a predetermined direction, a pair of spaced apart leading and trailing sheet confining means on each of the conveyor means, a second transporting unit which includes means for feeding successive sheets of the series of sheets between the leading and trailing confining means of one of the first and second conveyor means in a first portion of the endless path while the moving means advances the one conveyor means in the predetermined direction so that the sheets entering the first portion of the path form a growing row, and means for removing a previously accumulated fully grown row of sheets from between the leading and trailing confining means of the other of the first and second conveyor means while the other conveyor means is at or close to a standstill in a second portion of the endless path downstream of the first portion.

At least one of the two portions of the endless path is preferably at least substantially horizontal, and the second transporting means preferably includes additional conveyor means (e.g., sets of endless belt conveyors) which serve to advance successive sheets of the series of sheets downwardly along an at least substantially vertical second path which intersects the first portion of the endless path.

Each of the confining means can comprise at least one substantially flat plate-like member, and such members preferably extend at least substantially transversely of the direction of transport of sheets along the endless path. The moving means can comprise means for advancing the leading confining means of one of the pairs of confining means against the trailing confining means of the other pair of confining means before the confining means of the other pair accumulate a fully grown row of sheets and subsequent to removal of a fully grown row of sheets from between the confining means of the one pair.

At least one of the first and second conveyor means preferably comprises at least one endless chain or other endless conveyor, and the moving means preferably comprises several electric motors or other suitable prime mover means. For example, the moving means can comprise a first prime mover means which serves to alternately advance the pairs of confining means of the first and second conveyor means at a relatively high speed from the first into the second portion of the endless path, and a second prime mover means which serves to alternately advance the pairs of confining means of the first and second conveyor means at a relatively low speed along the first portion of the endless path. Such apparatus can further comprise means for monitoring the positions of the pairs of confining means in at least one portion of the endless path and for transmitting "start" and/or "stop" signals to the prime mover means.

The apparatus can also comprise means for facilitating automatic, semiautomatic or manual adjustment of the mutual spacing of confining means on each of the first and second conveyor means.

The removing means can comprise means for lifting fully grown rows of sheets off the first and second conveyor means and for thereupon moving the thus lifted rows substantially at right angles to the predetermined direction. The first and second conveyor means are preferably designed to support the sheets of the growing and fully grown rows in substantially vertical planes.

The apparatus can further comprise elongated rails or other suitable guide means for the confining means. The confining means move along the respective guide means during advancement along the first portion of the path as well as during advancement from the first into the second portion of the path. Each of the first and second conveyor means preferably includes an elongated upper reach which is preferably horizontal, and the first portion of the path is preferably adjacent to one end of such upper reach. The second portion of the endless path may but need not be immediately adjacent to the other end of the upper reach.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
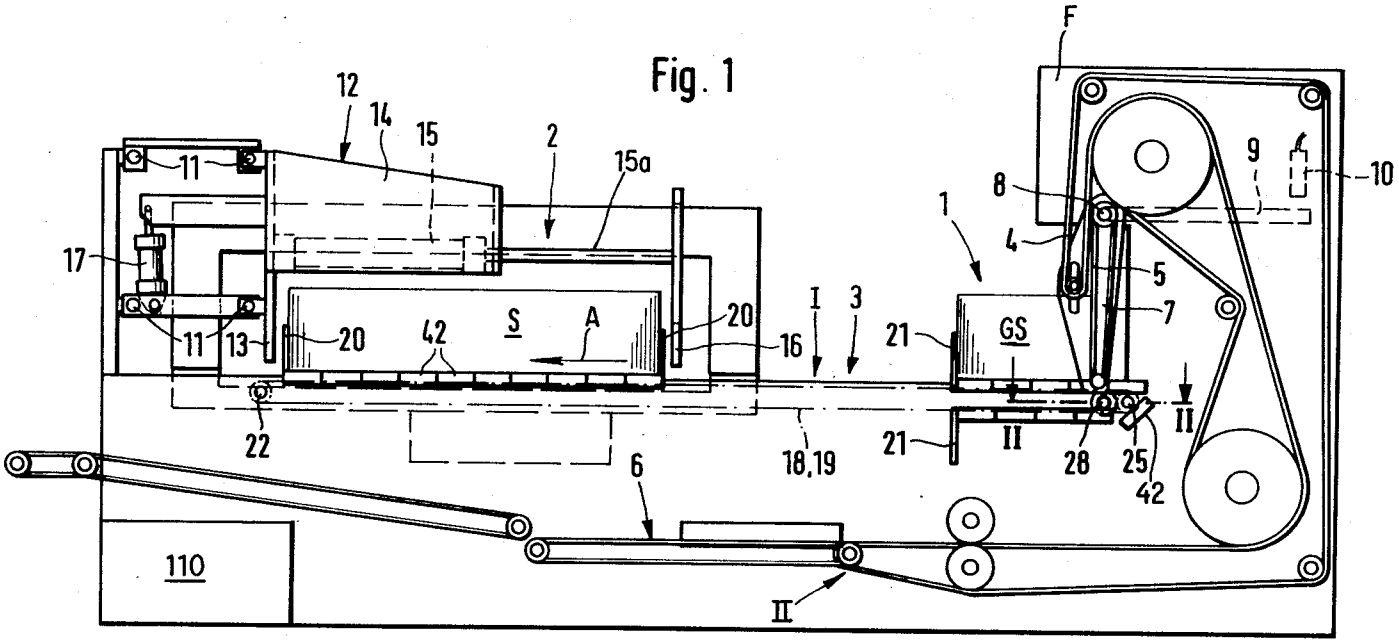
FIG. 1 is a schematic side elevational view of an apparatus which embodies the invention.
Figure 2:
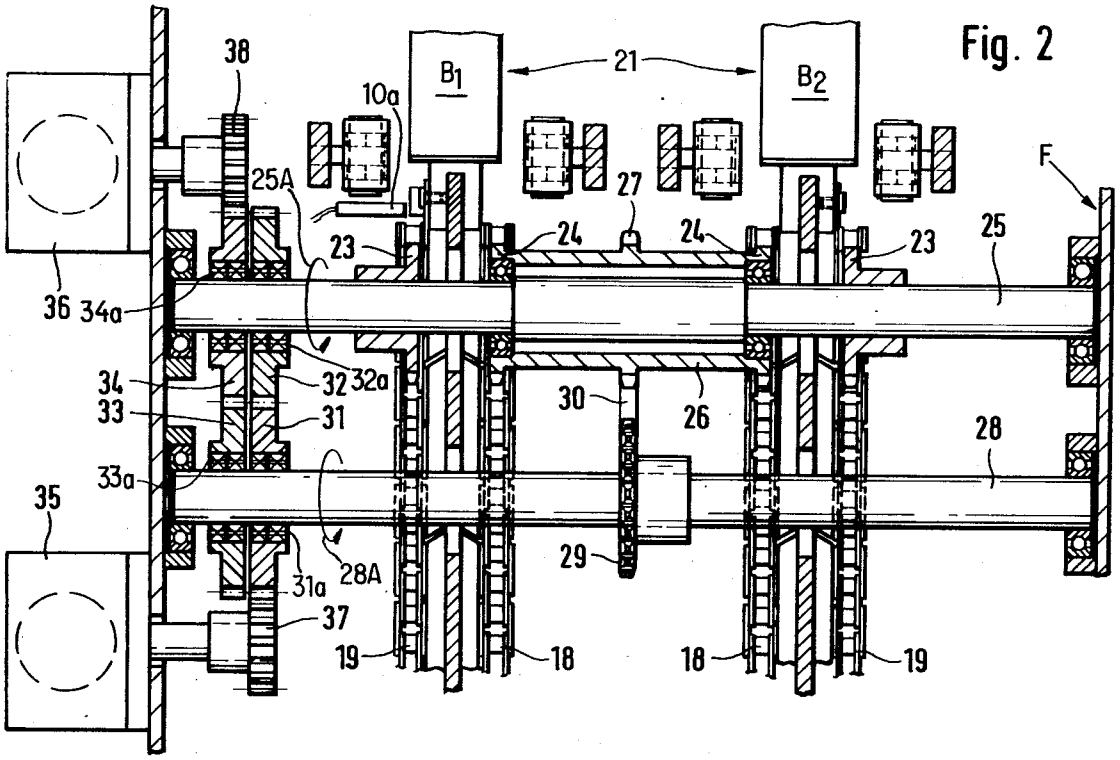
FIG. 2 is an enlarged fragmentary sectional view as seen in the direction of arrows from the line II—II in FIG. 1.
Figure 3:
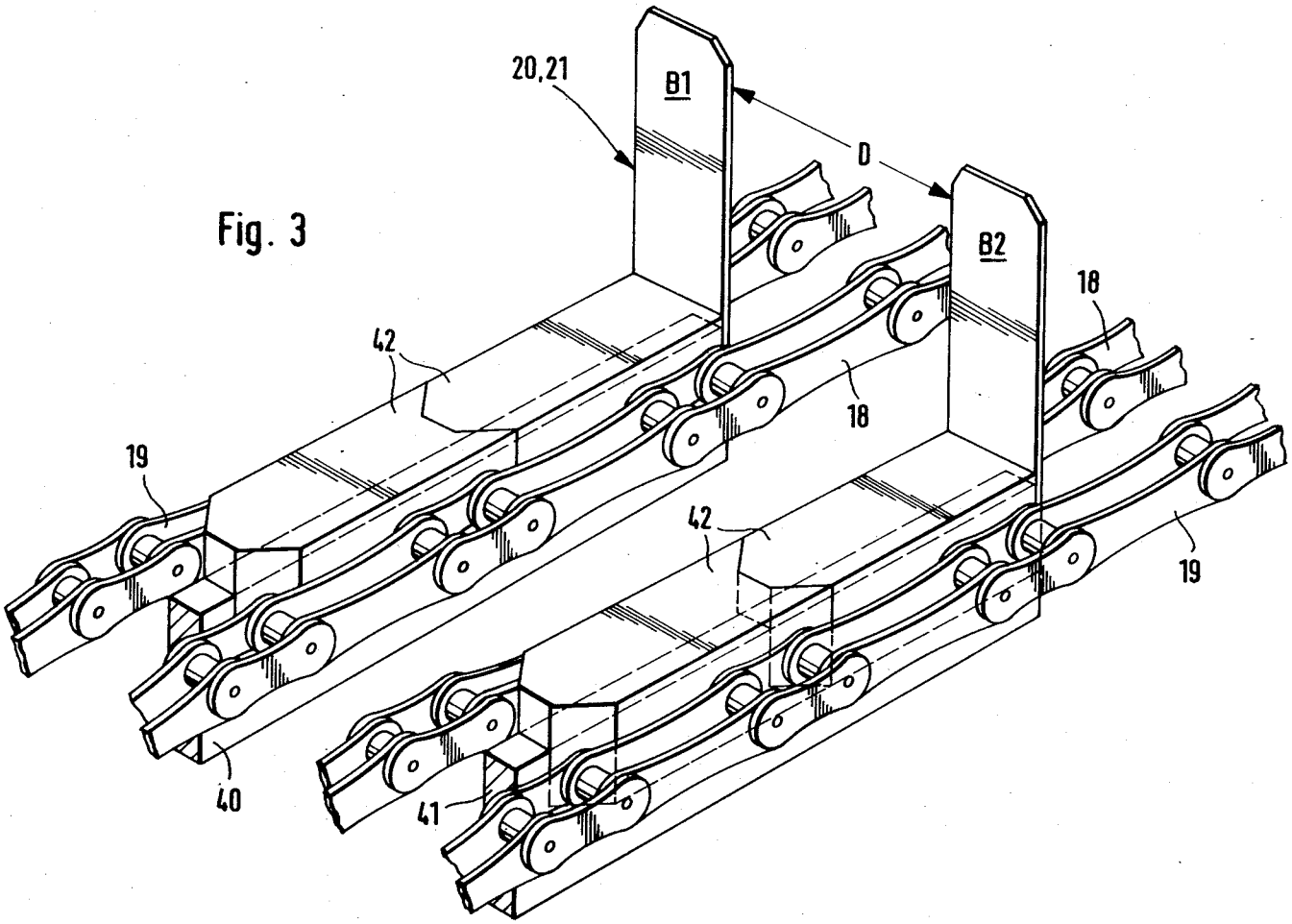
FIG. 3 is an enlarged fragmentary perspective view of a detail in the apparatus of FIG. 1.

The row forming apparatus which is shown in FIG. 1 comprises a first transporting unit I which includes two pairs of endless chain conveyors 18 and 19 (see also FIGS. 2 and 3) and a second transporting unit II including endless belt conveyors 4, 5, 6 serving to feed successive folded sheets of a scalloped stream of partially overlapping sheets to a first portion 1 of an endless path defined by the chain conveyors 18 and 19. The sheets which are fed to the first portion 1 of the endless path form a growing row GS, and the fully grown row S is transferred into a second portion 2 of the endless path. The portions 1 and 2 constitute the rear and front parts of that section of the endless path which is defined by the preferably horizontal upper reaches of the chains 18 and 19. The median portion 3 of such section extends between the portions 1 and 2.

The belt conveyor 6 of the transporting unit II serves to deliver a continuous or interrupted scalloped stream of sheets from a stream forming station, not shown, and successive sheets of the stream are taken over by the conveyors 4, 5 which transport such sheets along a substantially vertical path intersecting the first portion 1 of the endless path. The sheets of the growing row GS and the fully grown row S are disposed in substantially vertical planes and their folds rest (directly or indirectly) on the upper reaches of the conveyors 18 or 19. The conveyor 5 is preferably assembled of several (e.g., four) narrow endless belts which are disposed in parallel vertical planes behind the conveyor 4, as considered in the direction (arrow A) of transport of sheets along the aforementioned horizontal section of the endless path defined by the chain conveyors 18, 19 of the transporting unit I. The conveyors of the composite conveyor 5 are mounted on braces 7 pivotable about the axis of a horizontal shaft 8 which is mounted in the frame F of the improved apparatus. The shaft 8 is assumed to share the angular movements of the braces 7 and is rigidly connected with a lever 9 constituting a trip for an inductive signal generating proximity detector 10. Signals which are generated by the detector 10 denote the rate at which the row GS of sheets grows in the first portion 1 of the endless path.

The apparatus further comprises a row removing unit 12 which includes means for gripping and condensing successive fully grown rows S and for lifting such rows above and away from the portion 2 of the endless path for transport to a further station (not shown) in a direction at right angles to the plane of FIG. 1. The removing unit 12 is mounted on four horizontal rods 11 which are affixed to the frame F, which extend transversely of the direction indicated by the arrow A and which reciprocably support the unit 12. The latter comprises a mobile clamping jaw 13 extending downwardly from a carriage 14. The jaw 13 is fixedly secured to the carriage 14 which supports a fluid-operated cylinder 15 having a piston rod **15*a* for a second claw 16 which can engage the rearmost sheet of a fully grown row S in the path portion 3. The carriage 14 is movable along the rods 11 at right angles to the plane of FIG. 1, and the claw 16 is movable toward and away from the claw 13 to condense or release a fully grown row S. A fluid-operated motor 17 is provided to tilt the carriage 14 and the claws 13, 16 so as to raise a properly gripped and condensed row S above and away from the upper reaches of the conveyors 18, 19 preparatory to advancement of the carriage 14 along the rods 11**.

The transporting unit I further comprises a first pair of confining members 20 on the conveyors 18 and a second pair of confining members 21 on the conveyors 19. The confining members (20 or 21) which advance along the portion 1 of the endless path confine the growing row GS, and the confining members which advance from the portion 1, along the portion 3 and toward the portion 2 confine a fully grown row S.

Each of the confining members 20, 21 comprises two spaced-apart coplanar sheet-metal plates $B_1$ and $B_2$ (see FIG. 3) which are mounted on the chain conveyors 18 or 19 of the corresponding pair of such conveyors. The distance D between the plates $B_1$ and $B_2$ of each pair suffices to ensure that they can bypass the claws 13 and 16 of the removing unit 12 and vice versa. Thus, and referring to the left-hand portion of FIG. 1, the claw 13 can be moved by the carriage 14 between the plates $B_1$ and $B_2$ of the left-hand confining member 20 to engage the foremost sheet of the fully grown row S and the claw 16 can be moved by the piston rod **15*a* between the plates $B_1$ and $B_2$ of the right-hand confining member 20** to engage the rearmost sheet of the fully grown row S.

The chain conveyors 18 and 19 are trained over idler sprocket wheels on a shaft 22 located to the left of the portion 2 of the endless path, as viewed in FIG. 1. The chain conveyors 18 are further trained over a compound sprocket wheel 24 which is rotatable on a horizontal shaft 25, and the chain conveyors 19 are further trained over a pair of discrete sprocket wheels 23 which are non-rotatably affixed to the shaft 25. The compound sprocket wheel 24 has a hollow shaft 26 which is mounted on antifriction bearings surrounding the shaft 25. The median portion of the hollow shaft 26 carries a sprocket wheel 27 in mesh with a chain 30 receiving motion from a sprocket wheel 29 on a shaft 28 which is adjacent to and parallel with the shaft 25. The shaft 25 further carries two gears 32, 34 mounted on freewheels 32*a*, 34*a* which compel the gears 32, 34 to share all angular movements of the shaft 25 relative to the gears 32, 34 in one direction. Analogously, the shaft 28 carries two spur gears 31, 33 which are mounted on freewheels 31*a*, 33*a*. The directions in which the sprocket wheels 31, 33 and 32, 34 are respectively compelled to rotate with the corresponding shafts 28, 25 are indicated by arrows 28A, 25A (see FIG. 2). The moving means for the chain conveyors 18, 19 further comprises two prime movers (e.g., two reversible electric motors) 35 and 36 which transmit torque to the gears 31, 34 by way of additional spur gears 37, 38. The gear 31 mates with the gear 32, and the gear 34 mates with the gear 33. The speed $V_1$ of the prime mover 35 is less than the speed $V_2$ of the prime mover 36.

When the slower prime mover 35 is started to rotate its output element in a first direction, the gear 37 causes the gear 31 to rotate the shaft 28 in the direction which is indicated by the arrow 28A. The gear 31 then drives the gear 32 which rotates relative to the shaft 25. If the direction of rotation of the prime mover 35 is reversed, the gear 37 causes the gear 31 to rotate relative to the shaft 28 and to rotate the gear 32 so that the latter drives the shaft 25 in the direction of arrow 25A.

When the faster prime mover 36 is started to rotate in one direction, the sprocket wheel 38 drives the shaft 25 through the medium of the gear 34 and freewheel 34*a* so that the shaft 25 rotates in the direction of arrow 25A. The gear 34 drives the gear 33 which rotates relative to the shaft 28. When the direction of rotation of the prime mover 36 is reversed, the gear 34 rotates relative to the shaft 25 and drives the gear 33 which rotates the shaft 28 in the direction of arrow 28A.

It will be seen that the shaft 25 can be driven at a higher speed $V_2$ by the prime mover 36 or at a lower speed $V_1$ by the prime mover 35. The same holds true for the shaft 28. The shaft 25 drives the chain conveyors 19 by way of the sprocket wheels 23, and the shafts 28, 26 drive the chain conveyors 18 by way of the compound sprocket wheel 24.

The controls for the prime movers 35 and 36 are operated in such a way that the chain conveyors (18 or 19) whose confining members (20 or 21) are about to enter the portion 1 of the endless path are driven by the slower prime mover 35 while they are in the process of moving along the portion 1, i.e., while a growing row GS is being formed between the confining members 20 or 21. FIG. 1 shows the confining members 21 at the feeding station below the belt conveyors 4 and 5. The confining members 20 flank a fully grown row S in the portion 2 of the endless path and are at a standstill so that the fully grown row S can be removed by the claws 13 and 16. The advancement of a fully grown row S from the portion 1, along the portion 3 and into the portion 2 of the endless path is effected by the prime mover 36 at the higher speed $V_2$. As mentioned above, removal of the fully grown row S from the path portion 2 takes place by lifting the row S above the upper reaches of the conveyors 18 or 19 by the claws 13, 16 in response to actuation of the motor 17 and by thereupon causing the carriage 14 to move along the rods 11 toward or away from the observer of FIG. 1.

The removal of a fully grown row S is completed before the conveyors 19 accumulate a fully grown row between the confining members 21. The prime mover 36 then causes the confining members 20 to rapidly advance along the lower reaches of the conveyors 18, 19 so that the leading member 20 is located behind but is still spaced apart from the trailing member 21 before the growing row GS of FIG. 1 is converted into a fully grown row S. The leading confining member 20 moves to a position immediately behind the trailing confining member 21 as soon as the trailing member 21 reaches the lower end of the conveyor 5; such movement of the leading confining member 20 is effected by the prime mover 36 at the higher speed $V_2$. The row GS is then converted into a fully grown row S and the conveyors 4, 5 are then arrested for a short interval of time so as to allow for rapid advancement of the freshly grown row S from the portion 1, along the portion 3 and into the portion 2 of the endless path. At the same time or immediately thereafter, the prime mover 35 starts to drive the conveyors 18 at the lower speed $V_1$ so that the space between the clamping members 20 begins to accumulate a growing row GS. The cycle is then repeated in the aforedescribed manner, i.e., the claws 13, 16 of the removing unit 12 lift the fully grown row S off the conveyors 19 and the conveyors 19 are thereupon advanced at the higher speed $V_2$, first to a position of readiness in which the leading member 21 is located slightly behind the trailing member 20 and thereupon to a position in which the leading member 20 is located immediately behind the trailing member 21. The conveyors 4, 5 are arrested when the confining members 20 flank a fully grown row S, and the next row is then accumulated between the confining members 21.

The controls for the prime movers 35, 36 receive "start" and/or "stop" signals from the proximity detector 10 and/or from other detectors (see the detector 10*a* in FIG. 2) which are adjacent to the endless path of movement of the confining members 20 and 21. The control means is shown schematically at 110.

The improved apparatus further comprises elongated guide means in the form of straight horizontal rails 40, 41 which are adjacent to the upper reaches of the conveyors 18 and 19. The guide rails 40, 41 support two followers 42 in the form of blocks made of a synthetic plastic material. One follower 42 is located between the confining members 20 and the other follower is located between the confining members 21. The folds of sheets which form a growing row GS or a fully grown row S rest on the respective follower 42. The followers 42 are detachably secured to the respective conveyors 18, 19, the same as the confining members 20 and 21. This renders it possible to convert the apparatus for accumulation of shorter or longer rows. Each of the followers 42 comprises several links (see FIG. 1 or 3) so that the followers can move along the end turns of the respective conveyors 18 and 19. The followers 42 can constitute the means for adjustably and detachably securing the confining members 20 and 21 to the respective chain conveyors.

Each pair of confining members (20 or 21) and the corresponding follower 42 can be said to constitute a slide which travels (at the speed $V_1$ and thereupon at the speed $V_2$) along the endless path defined by the transporting unit I. The length of each such slide can be altered by replacing the previously used follower 42 with a longer or shorter follower. It is even possible to use a shorter follower simultaneously with a longer follower.

The output of the improved apparatus is higher than that of the conventional apparatus because the confining members 20 or 21 which flank a fully grown row S can be driven at a speed $V_2$ which is much higher than the speed ($V_1$) of the confining members flanking a growing row GS. The speed $V_2$ can be sufficiently high to allow for manual removal of fully grown rows S from the path portion 2.

If the output of the improved apparatus need not exceed the output of a conventional apparatus, the speed $V_1$ can be lowered sufficiently to allow for highly predictable accumulation of rows S while the faster prime mover 36 ensures timely removal of fully grown rows S from the portion 2 of the endless path, either by hand or in a semiautomatic or fully automatic way.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting a series of sheets, particularly a stream of partially overlapping folded sheets, into successive rows of at least substantially fully overlapping sheets, comprising a first transporting unit defining an endless path and including discrete first and second conveyor means; means for moving said conveyor means along said path independently of each other in a predetermined direction, each of said conveyor means having spaced-apart leading and trailing sheet confining means, as considered in said direction; a second transporting unit including means for feeding successive sheets of said series between the leading and trailing confining means of one of said conveyor means in a first portion of said path while said moving means continuously advances said one conveyor means in said direction so that the sheets entering the first portion of said path form a growing row; and means for removing a previously accumulated fully grown row of sheets from between the leading and trailing confining means of the other of said conveyor means while said other conveyor means is at a standstill in a second portion of said path downstream of said first portion, as considered in said direction, said moving means including means for advancing the leading confining means of one of said conveyor means to a position against the trailing confining means of the other of said conveyor means not later than when the confining means of the other conveyor means accumulate a fully grown row of sheets and subsequent to removal of a fully grown row of sheets from between the confining means of said one conveyor means.

2. The apparatus of claim 1, wherein at least one portion of said path is at least substantially horizontal.

3. The apparatus of claim 1, wherein said second transporting unit includes additional conveyor means arranged to advance successive sheets of said series downwardly along an at least substantially vertical second path which crosses the first portion of said endless path.

4. The apparatus of claim 1, wherein each of said confining means comprises a substantially flat plate-like member.

5. The apparatus of claim 4, wherein said plate-like members extend at least substantially transversely of the direction of transport of sheets along said endless path.

6. The apparatus of claim 1, wherein each of said conveyor means comprises at least one endless chain.

7. The apparatus of claim 1, wherein said moving means comprises several electric motors.

8. The apparatus of claim 1, wherein said moving means includes first prime mover means arranged to alternately advance the confining means of said first and second conveyor means at a relatively high speed from said first portion into said second portion of said path and second prime mover means arranged to alternately advance the confining means of said first and second conveyor means at a relatively low speed along the first portion of said path.

9. The apparatus of claim 8, further comprising means for monitoring the positions of said pairs of confining means in at least one portion of said endless path and for transmitting start and stop signals to said prime mover means.

10. The apparatus of claim 1, further comprising means for facilitating adjustment of the mutual spacing of the confining means of each of said conveyor means.

11. The apparatus of claim 1, wherein said removing means includes means for lifting fully grown rows of sheets off said conveyor means and for thereupon moving the thus lifted rows substantially at right angles to said predetermined direction.

12. The apparatus of claim 1, wherein each of said conveyor means comprises several discrete endless conveyors.

13. The apparatus of claim 1, wherein said conveyor means are arranged to support the sheets of the growing and fully grown rows in substantially vertical planes.

14. The apparatus of claim 1, further comprising stationary guide means for said confining means, said confining means being arranged to move along the respective guide means during advancement along said first portion and during advancement from said first to the second portion of said path.

15. The apparatus of claim 1, wherein each of said conveyor means includes an elongated upper reach and the first portion of said path is adjacent to one end of said upper reach.

* * * * *